US008381316B2

(12) United States Patent
Edwards

(10) Patent No.: US 8,381,316 B2
(45) Date of Patent: Feb. 26, 2013

(54) HEAD APPAREL

(76) Inventor: Allan Milton Edwards, Dorchester, MA (US)

( * ) Notice: Subject to any disclaimer, the term of this patent is extended or adjusted under 35 U.S.C. 154(b) by 190 days.

(21) Appl. No.: 12/909,338

(22) Filed: Oct. 21, 2010

(65) Prior Publication Data

US 2012/0096626 A1 Apr. 26, 2012

(51) Int. Cl.
*A42B 1/00* (2006.01)

(52) U.S. Cl. ..... 2/175.3; 297/393

(58) Field of Classification Search .... 2/209.11–209.13, 2/209.4, 175.3; 297/393
See application file for complete search history.

(56) References Cited

U.S. PATENT DOCUMENTS 1,612,750 A * 12/1926 Stake ..... 2/12
2,043,330 A * 6/1936 Nelkin ..... 2/175.3
2,106,570 A * 1/1938 Lipton ..... 2/175.3
4,339,151 A 7/1982 Riggs
6,607,245 B1 * 8/2003 Scher ..... 297/393
6,886,186 B2 * 5/2005 Jansen ..... 2/422
7,628,456 B1 12/2009 Swartz
7,665,154 B2 * 2/2010 Gerstel Costello ..... 2/195.2
D615,453 S 5/2010 Spears

* cited by examiner

*Primary Examiner* — Katherine Moran
(74) *Attorney, Agent, or Firm* — Guerin & Rodriguez, LLP

(57) ABSTRACT

Described is head apparel for restraining the head of a wearer. The head apparel includes headwear having an outer surface and an opening that exposes an interior surface configured to receive the head of the wearer. The headwear also includes a restraining device attached to the outer surface of the headwear. The restraining device has a first state in which a length of the restraining device extends from the headwear and is configured to engage a stationary object to restrain the head against the stationary object. The restraining device has a second state in which the length of the restraining device is substantially secured to the headwear.

2 Claims, 10 Drawing Sheets

HEAD APPAREL

FIELD OF THE INVENTION

The present invention relates generally to head apparel, and more specifically, to head apparel having a restraining device for stabilizing the head of a person when the head apparel is worn by the person and the restraining device is positioned about an upper portion of a seat.

BACKGROUND

It is well known that people often enjoy sleeping in their seats while traveling in an airplane, train, automobile, or other mode of transportation. However, it is difficult for a person to sleep in his or her seat when the back portion of the seat is in an upright position or reclined position. Thus, it is difficult for a traveler to be comfortable when attempting to sleep, especially because a traveler's head is not stabilized while in an upright position. As a result, the traveler's head can fall forward during sleep.

Travelers often attempt to lean their heads against a stationary object such as a window, or rely on a pillow placed between the head and the back surface of the seat for comfort. However, when the head is not secured against the stationary object, the traveler's head is subject to abrupt movement during sleep.

SUMMARY

In one aspect, the invention features head apparel for restraining the head of a wearer, the head apparel. The head apparel includes headwear and a restraining device. The headwear has an outer surface and an opening that exposes an interior surface configured to receive the head of the wearer. The restraining device is attached to the outer surface of the headwear. The restraining device has a first state in which a length of the restraining device extends from the headwear and is configured to engage a stationary object to restrain the head against the stationary object. The restraining device has a second state in which the length of the restraining device is substantially secured to the headwear.

In another aspect, the invention features head apparel for restraining a head of a wearer against a stationary object. The head apparel comprises headwear, a pair of fastening devices, and a strap. The headwear has an outer surface and an opening that exposes an interior surface configured to receive the head of the wearer. The pair of fastening devices are disposed on the outer surface of the headwear. The strap has two ends and a length. At least a portion of the length extending between the fastening devices. The strap has a first state in which portions of the strap are secured by the fastening devices and the strap is configured to extend from the headwear to engage with an upper portion of a seat to restrain the head. The strap has a second state in which the ends of the strap are configured to be attached to the outer surface so that the length of the strap is substantially secured to the outer surface of the headwear.

In another aspect, the invention features head apparel for restraining a head of a wearer against a stationary object. The head apparel comprises headwear, a pair of fastening devices, and a strap. The headwear has an outer surface and an opening that exposes an interior surface configured to receive the head of the wearer. The pair of fastening devices is disposed on the outer surface of the headwear. The strap has two end portions and a length. At least a central portion of the length extends between the fastening devices. The strap has a first state in which the strap is secured by the fastening devices and the end portions of the strap are configured to extend from the headwear to engage with an upper portion of a seat to restrain the head to the seat. The strap has a second state in which the end portions of the strap are configured to be substantially secured to the inner surface of the headwear.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

In the following description, specific details are set forth although it should be appreciated by one of ordinary skill that the present invention can be practiced without at least some of the details. In some instances, known features or processes are not described in detail so as not to obscure the present invention.

The present teaching will now be described in more detail with reference to exemplary embodiments thereof as shown in the accompanying drawings. While the present teaching is described in conjunction with various embodiments and examples, it is not intended that the present teaching be limited to such embodiments. On the contrary, the present teaching encompasses various alternatives, modifications and equivalents, as will be appreciated by those of skill in the art. Those of ordinary skill having access to the teaching herein will recognize additional implementations, modifications and embodiments, as well as other fields of use, which are within the scope of the present disclosure as described herein.

Embodiments of head apparel described herein include a restraining device coupled to headwear, or headgear, which is worn on a person's head in a conventional manner. For example, the headwear can be worn as a baseball cap, winter hat, helmet, and the like. The restraining device is secured to either the outer surface or the inner surface of the headwear when the restraining device is not in use. Thus, the head apparel can be worn by a person as part of a wardrobe or for other purposes such as for protecting the person's head from sunburn or cold weather.

The restraining device, when expanded, can be positioned about a stationary object, for example, a headrest of a travel seat. In this manner, the restraining device stabilizes the person's head against the surface of the stationary object so as to prevent the head from movement during sleep that would otherwise prevent the person from a sound sleep. In addition to wearing the head apparel for purposes of fashion or head protection, the head apparel can be worn to allow the wearer to sleep when seated when traveling in an automobile, train, or airplane. Alternatively, the head apparel can be worn by people with neck or back injuries, who cannot use their neck muscles effectively to hold their heads in an upright position, regardless of whether or not such people are awake or asleep.

Figure 1A:
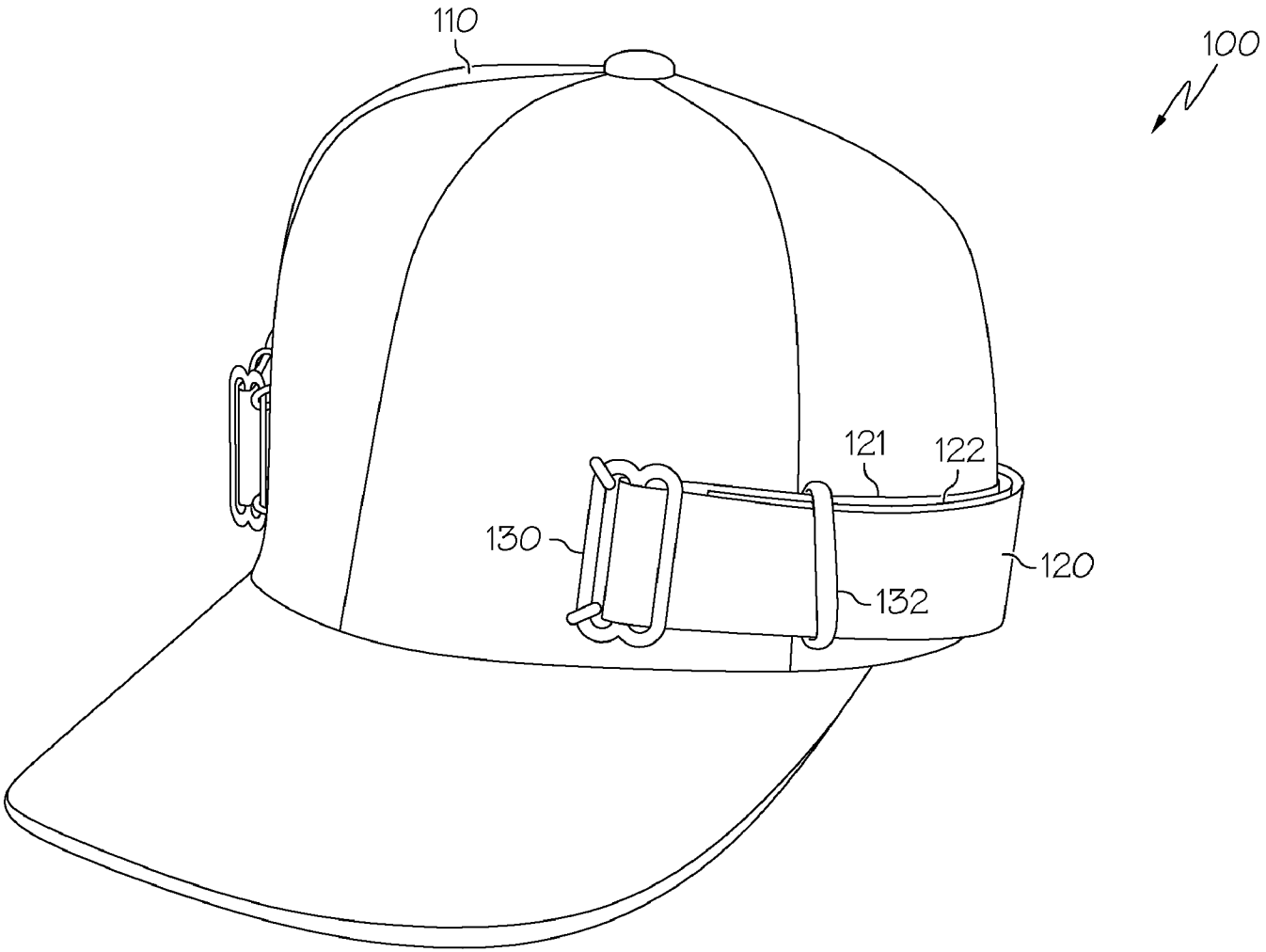
FIG. 1A is a perspective view of an embodiment of an article of head apparel, in accordance with principles of the invention.
Figure 1B:
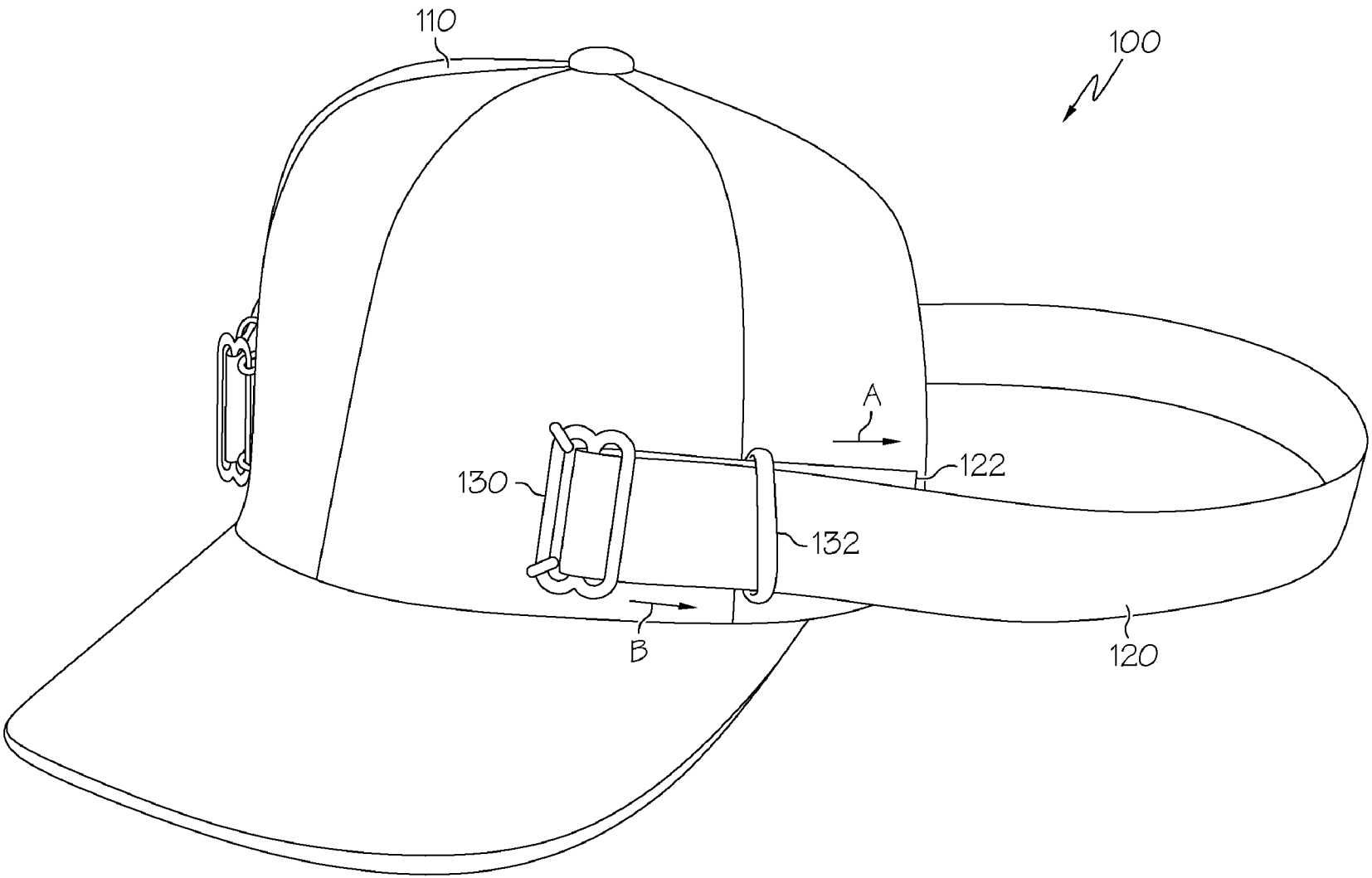
FIG. 1B is a perspective view of the head apparel shown in FIG. 1A.

FIG. 1A is a perspective view of an embodiment of an article of head apparel 100 that includes a restraining device 120 secured about an outer surface of headwear 110, in accordance with principles of the invention. FIG. 1B is a perspective view of the restraining device 120 extending from the headwear 110.

Figure 2:
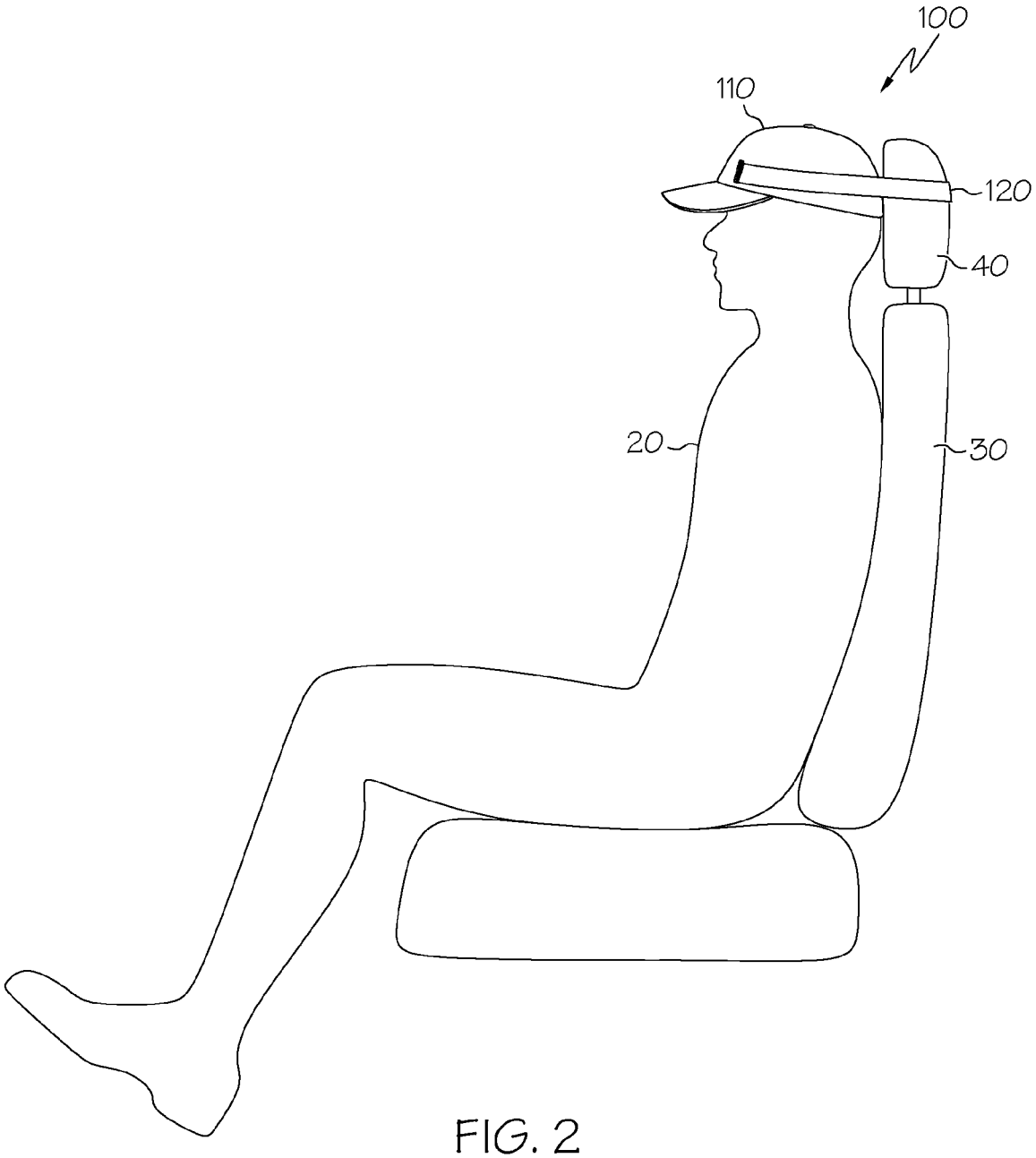
FIG. 2 is an illustrative view of a person positioned in a seat and wearing head apparel that restrains the head of the wearer to the seat, in accordance with principles of the invention.

The headwear 110 and the restraining device 120 of the head apparel 100 are collectively adapted to restrain the wearer's head to a stationary object such as a travel seat when the wearer is seated. In a preferred embodiment, as shown in FIG. 2, the restraining device 120 is secured about an upper back portion 40 of a travel seat 30 such that the restraining device 120 extends substantially horizontally around the travel seat 30 and the head of a person 20 wearing the head apparel 100, also referred to as a wearer.

In an embodiment, the headwear 110 is of a conventional construction, for example, a commercially available baseball cap. Alternatively, the headwear 110 can be, but not limited to hats, helmets, visors, headbands, or other head coverings or headgear known to those or ordinary skill in the art as conformably fitting about at least a portion of the wearer's head.

The headwear 110 has an interior surface configured for receiving the wearer's head. In an embodiment, the interior surface and/or outer surface of the headwear 110 are formed of soft and compliant materials such as cotton, wool, or acrylic, for substantially conforming to at least a portion of the wearer's head. In another embodiment, the outer surface has a rigid shell, for example, a helmet, and the interior surface includes a compliant material, such as a foam liner, for substantially conforming to at least a portion of the wearer's head.

The restraining device 120 can be directly attached to the outer surface of the headwear 110, or attached to the outer surface of the headwear 120 by a fastening device, for example, one or more slides 130 described herein. The restraining device 120 can be a strap, belt, rope, or other thin strip of fabric formed of materials that can accommodate a force, such as the weight of the wearer's head. By way of example, the restraining device 120 can be fabricated from leather, polymers, or other durable fabrics. Such materials can include elastic properties, permitting the restraining device 120 to expand beyond an initial state when a force is applied thereto, such as the weight of the wearer's head. However, the restraining device 120 nevertheless substantially restrains the wearer's head against an object, regardless of the elasticity of the restraining device.

In the event of a collision or sudden braking of the vehicle in which the wearer is seated, excessive force may be applied by the wearer's head. The slide 130 and/or restraining device 120 can be configured to include a safety device (not shown) that withstands a maximum force threshold, and that separates the restraining device 120 from the slide 130 when a force is applied to the restraining device 120 that exceeds the maximum force threshold.

The safety device can include a locking mechanism on the slide 130 that secures the restraining device 120 to the slide 130 when the restraining device 120 is positioned about a stationary object. This feature can reduce the risk of a head, neck, or back injury to the wearer in the event of an accident.

The restraining device 120 has first and second ends 122 and a contiguous length therebetween. The first and second ends 122 are each attached to the outer front or side surfaces of the headwear 110. In a preferred embodiment, each end 122 of the restraining device 120 is secured to the headwear 110 by a slide 130, for example, a three-bar slide, which allows the length of the restraining device 120 to be adjusted for proper fitting between the wearer and the seat. In another embodiment, both ends 122 of the restraining device 120 are secured to the headwear 110 by a single slide 130 so that one end 122 is secured to the slide 130, and the other end 122 can be secured in place in the slide 130, or can be adjusted so that different locations along the length of the restraining device 120 are secured in place in the slide 130. In other embodiments, ends 122 of the restraining device 120 are directly or indirectly attached to the headwear 110 using staples, sewing materials such as thread, buttons, snaps, zippers, clasps, buckles, closures, adjusters, rings, rivets, glue, Velcro®, or other fasteners known to those of ordinary skill in the art.

Figure 3:
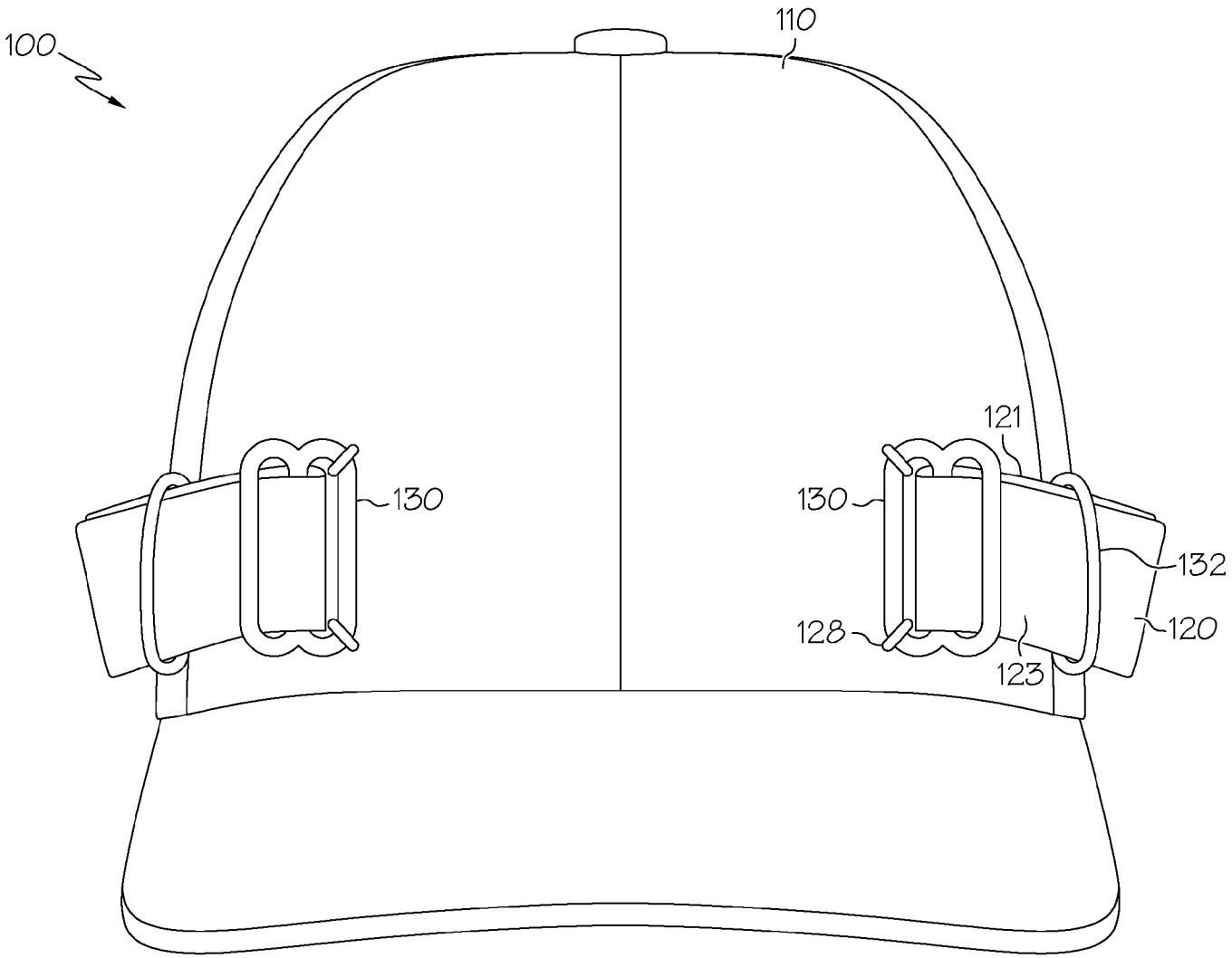
FIG. 3 is a front view of the head apparel shown in FIGS. 1 and 2.

FIG. 3 is a front view of the head apparel 100. Two slides 130, referred to as a first slide and second slide, respectively, are each attached to the outer front or side surfaces of the headwear 110.

Each slide 130 can be sewn to the headwear 110 with thread 128, or with staples, glue, or other fasteners known to those of ordinary skill in the art. An emblem, monogram, logo, indicia, graphic, or design can be formed on a front portion of the headwear 110 between the first and second slides 130, by embroidering or printing, or by attaching a patch to the headwear 110.

Each end 122 of the restraining device 120 is inserted in a corresponding first or second slide 130 as shown in FIG. 1B. The slide 130 frictionally retains the restraining device 120 in place during operation. The length of the restraining device 120 between the first and second slides 130 is increased or decreased by adjusting the location of the restraining device 120 relative to the first and/or second slide 130. A portion of the restraining device 120 between the first and second slides 130 is increased by applying a manual force to pull the restraining device 120 in a direction B as shown in FIG. 1B. In this manner, the length between the outermost end 122 and the corresponding slide 130 decreases, while the length of the restraining device 120 between the first and second slides 130 increases. A portion of the restraining device 120 between the first and second slides 130 is decreased by applying a manual force to pull the end 122 of the restraining device 120 in a direction A as shown in FIG. 1B. In this manner, the length between the outermost end 122 of the restraining device 120 and the corresponding slide 130 increases, while the length of the restraining device 120 between the first and second slides 130 decreases.

Figure 4:
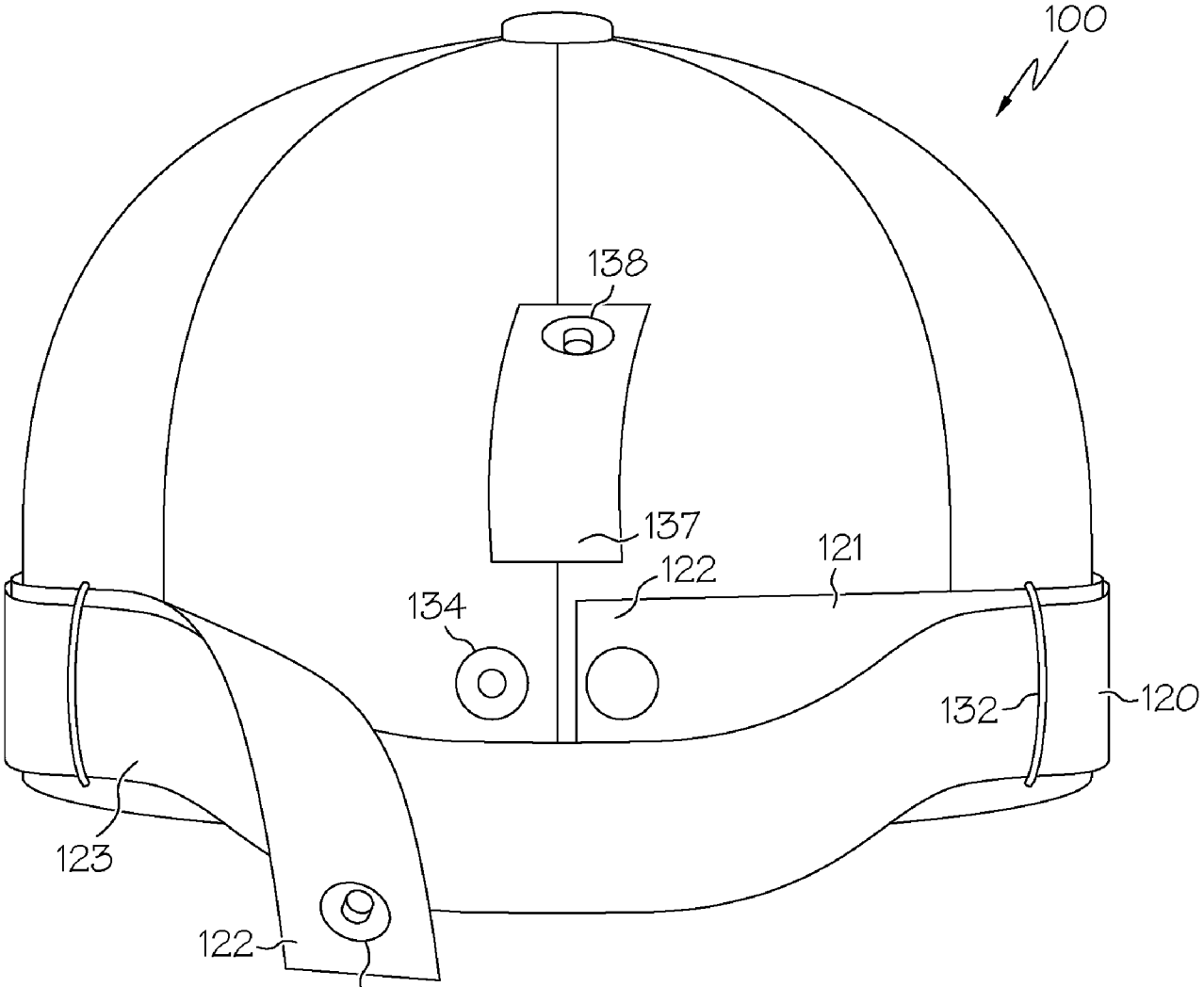
FIG. 4 is a rear view of the head apparel shown in FIGS. 1 to 3.

FIG. 4 is a rear view of the head apparel 100. The headwear 110 includes at least one snap fastener 134 attached to a rear portion of the headwear 110. The snap fastener 134 includes an attachment device that is secured to the outer surface of the head apparel 100. The attachment device can be a post-style attachment device or a prong-style attachment device. Each outermost end 122 of the restraining device 120 includes a snap fastener 124 corresponding to a snap fastener 134 of the headwear 110 so that the snap fasteners 124, 134 can be coupled to each other, or separate from each other. The snap fastener 124 comprises a closure unit, for example, a socket-style or stud-style closure unit for coupling with the attachment device of the snap fastener 134 of the headwear 110 when the restraining device 120 is not in use. While snap fasteners 124, 134 are shown in FIG. 4, other fasteners such as clips, buttons, magnets, Velcro® connectors, or other fastener known to those of ordinary skill in the art can be used to attach the restraining device 120 to the headwear 110.

When the restraining device 120 is not in use, the length of the restraining device 120 is reduced from a single contiguous length between the first and second slides 130 to one or more windings of restraining device 120 between the first and second slides 130 about the outer surface of the headwear 110. A portion 121 of the restraining device 120, referred to as a first winding, is inserted through the first slide 130 until the outermost end 122 is proximal to the rear portion of the headwear 110, and coupled to the rear portion of the headwear 110 by snapping the snap fasteners 124 and 134. A second winding 123 of the restraining device 120 extends from the first slide 130 to the second slide 130. The first and second windings 121, 123 can be secured to the outer surface of the headwear 110 by one or more loops 132.

The headwear 110 also includes a strap 137 at the rear portion of the headwear 110 for securing the outermost ends 122 against the headwear 110 when the restraining device 120 is not in use. The strap 137 includes a first end that is attached to the headwear 110 by sewing, gluing, or other attachment process. A second end includes a snap fastener 138 attached to a corresponding snap fastener (not shown), similar to the snap fastener 134 described herein. In other embodiments, fasteners such as clips, buttons, magnets, Velcro® connectors, or other fastener known to those of ordinary skill in the art can be used to attach the second end of the strap 137 to the headwear 110.

Figure 5A:
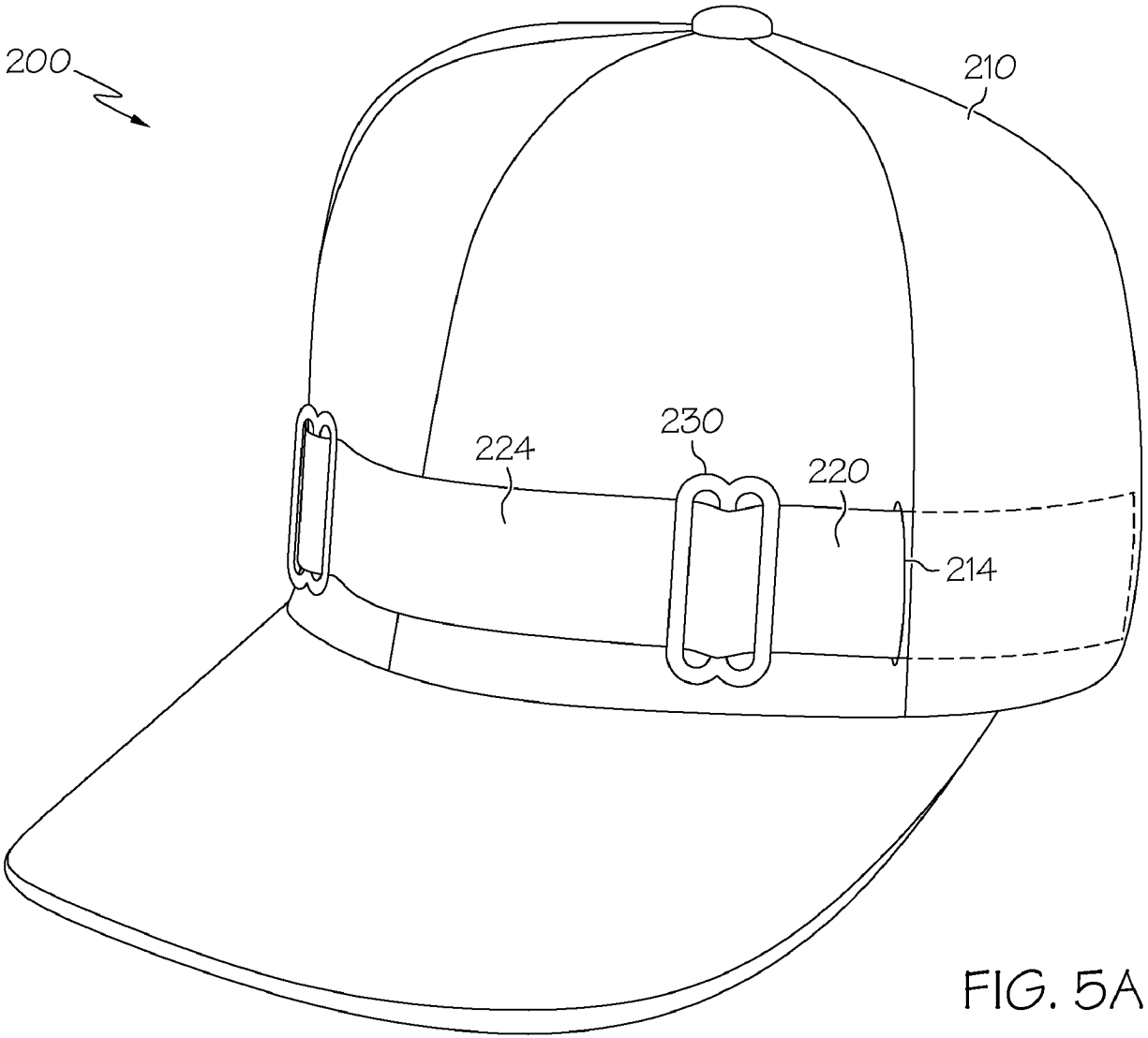
FIG. 5A is a perspective view of another embodiment of head apparel, in accordance with principles of the invention.
Figure 5B:
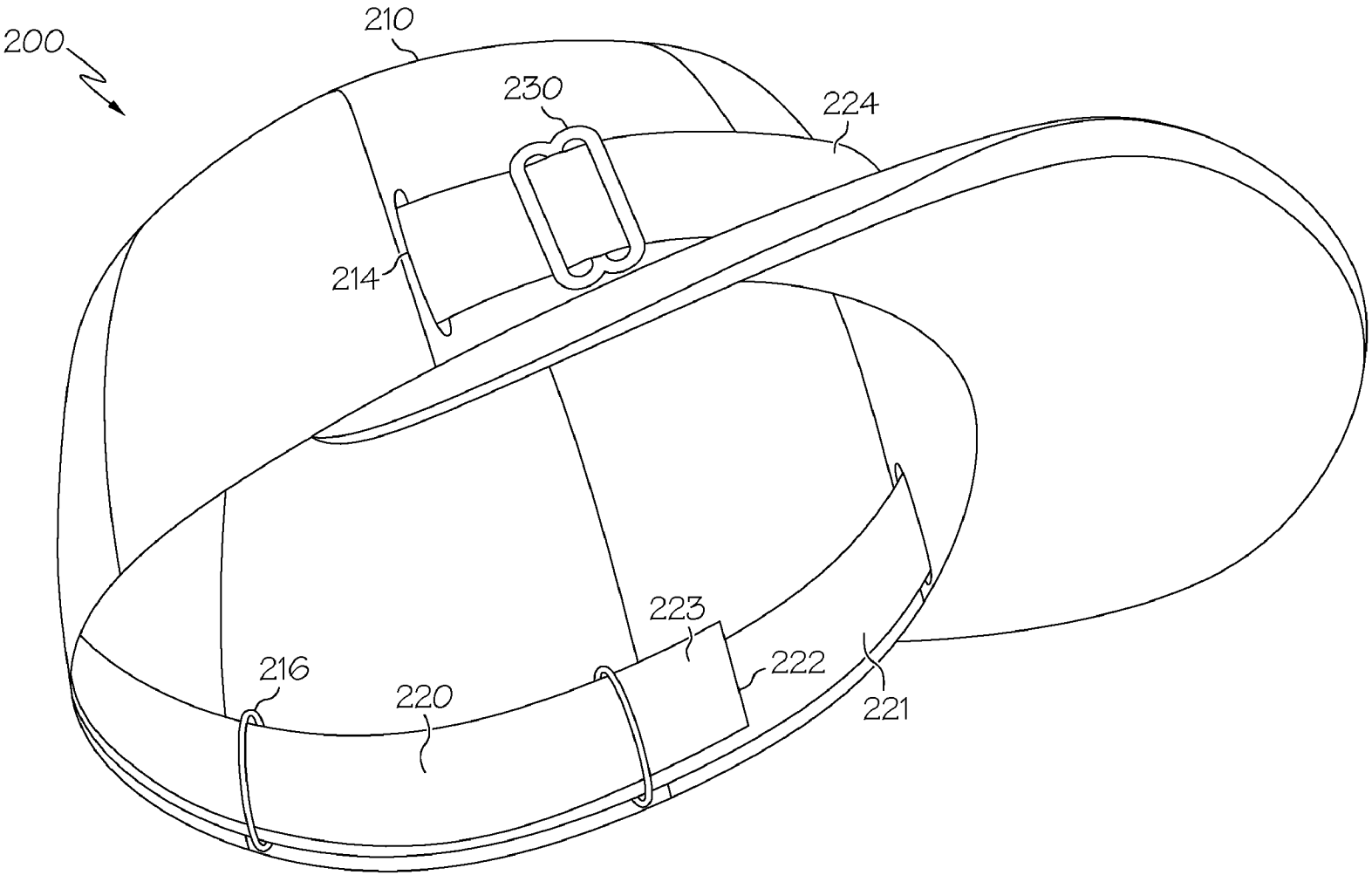
FIG. 5B is a perspective view of the head apparel of FIG. 5A.
Figure 6:
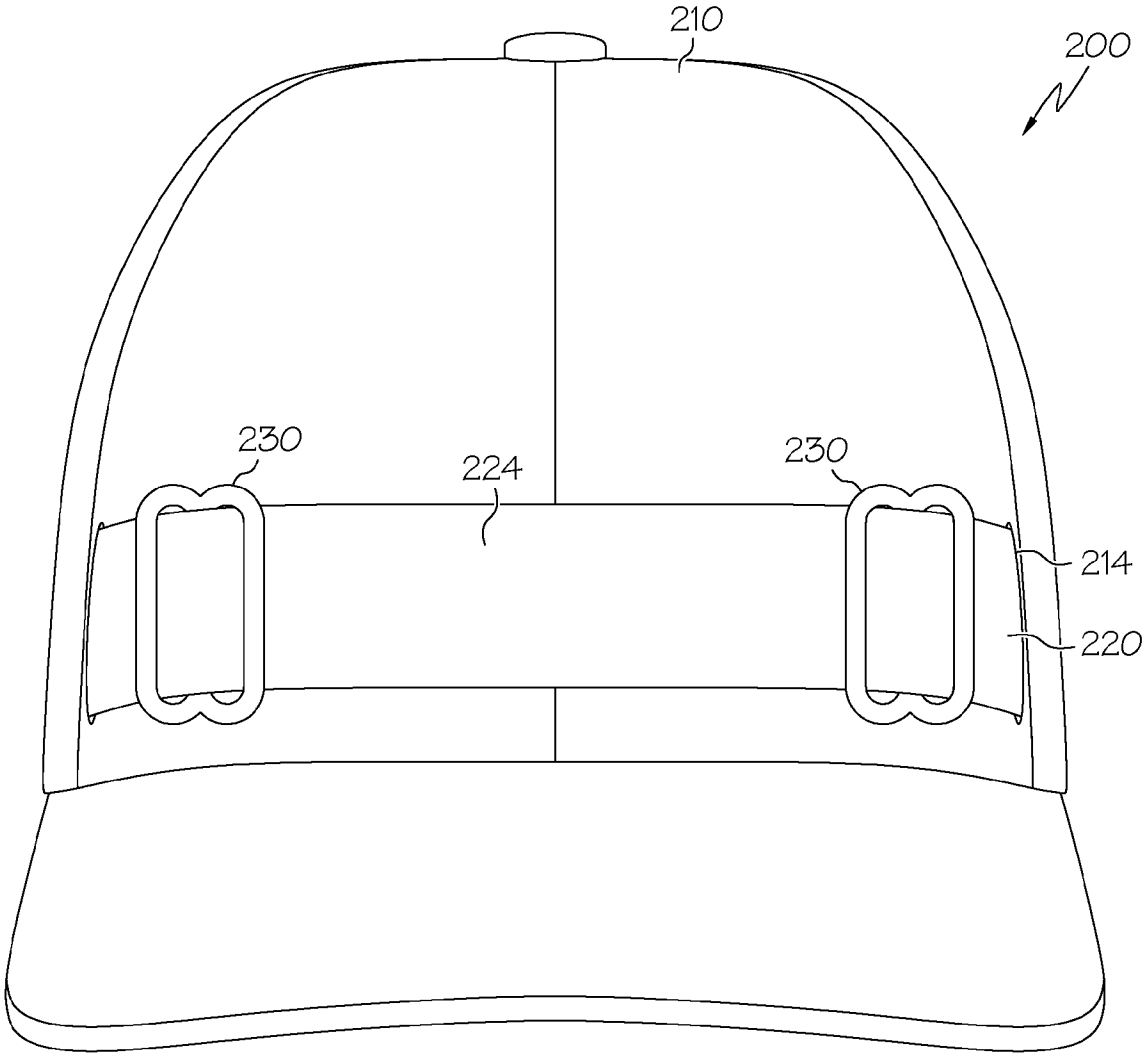
FIG. 6 is a front view of an embodiment of the head apparel shown in FIGS. 5A and 5B.

FIGS. 5-7 are perspective views of an embodiment of head apparel 200 that includes a restraining device 220 secured about an inner surface of headwear 210. The head apparel 200 also includes one or more slides 230, which can be similar to the headwear 110, restraining device 120, and slides 130 described above with regard to FIGS. 1-4.

The two ends 222 of the restraining device 220, referred to as outermost ends, extend through openings 214 in the headwear 200, and are secured to the interior of the headwear 210 as shown in FIGS. 5A and 5B when not in use. The two ends 222 can extend from the headwear 210 for positioning about a stationary object such as a travel seat. A central portion 224 of the restraining device 220 is secured to the outer front or side surface of the headwear 220 by one or more slides 230, allowing the length of the restraining device 120 to be adjusted in a manner similar to that described with regard to FIGS. 1-4.

The headwear 210 includes loops 216 positioned about the inner rim of the headwear 210 for holding the length of the restraining device 220 in place against the inner rim when the restraining device 220 is not in use. The loops 216 can be similar to loops 132 described in FIGS. 1-3. For example, the first and second windings 221, 223 can be secured to the inner surface of the headwear 110 by the loops 216. The first and second windings 221, 223 can be similar to the windings 121, 123 described with regard to FIGS. 1 and 3, except that the locations of the windings 221, 223 are in the headwear interior.

In another embodiment, one or more openings (not shown) are provided in the back region of the headwear 210. When the restraining device 220 is in an extended state, each outermost end 222 extends from the headwear 210 through a corresponding opening.

Figure 7A:
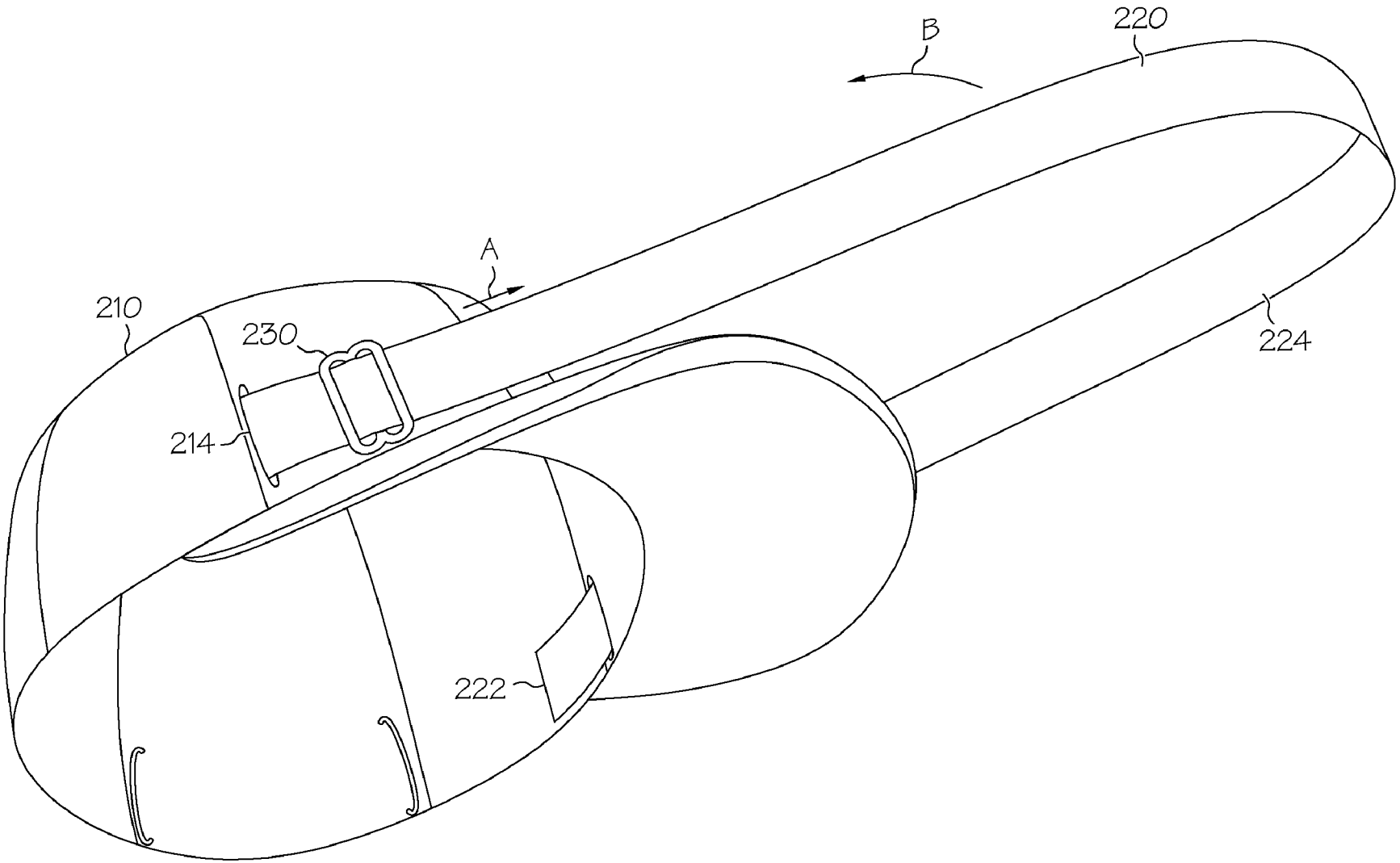
FIG. 7A is a perspective view of the head apparel shown in FIGS. 5 and 6, wherein the restraining device extends from the headwear.
Figure 7B:
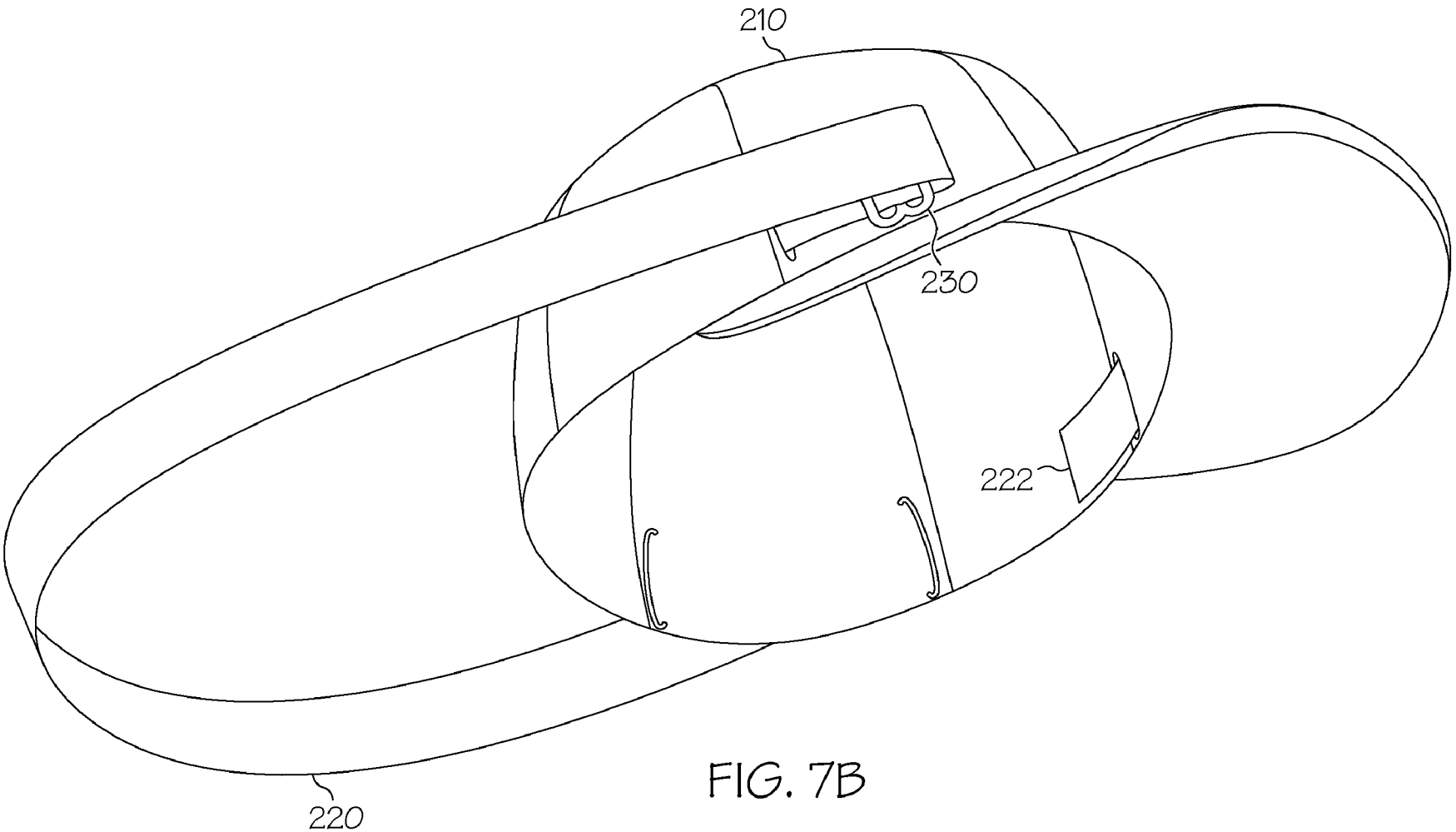
FIG. 7B is another perspective view of the head apparel shown in FIGS. 5-6.

The length of the central portion 224 of the restraining device 220 between the two slides 230 can be increased as shown in FIGS. 7A and 7B, and positioned about a stationary object such as a headrest. The length of the central portion 224 is limited by the overall length of the restraining device 220. For example, the length of the central portion 224 can be increased by applying a manual force to the central portion 224 to pull the restraining device 220 in a direction B as shown in FIG. 7A. The length of the central portion 224 can be increased until the outermost ends 222 are proximal to the slides 230. Once the desired length is achieved, the restraining device 220 can be moved in a direction B by flipping the restraining device 220 over the headwear 220 (see FIG. 7B) for positioning about a stationary object.

While embodiments of the head apparel have been described with respect to travelers, who can sleep when seated in a substantially upright position while traveling, the head apparel is not limited to such applications. Other applications are contemplated in which the head apparel is used by people with neck or back injuries, who may be prevented from using their neck muscles to hold their heads in an upright position.

While the invention has been shown and described with reference to specific embodiments, it should be understood by those skilled in the art that various changes in form and detail may be made therein without departing from the spirit and scope of the invention.

What is claimed is:

1. Head apparel for restraining a head of a wearer against a stationary object, comprising:

headwear having an outer surface and an opening that exposes an interior surface configured to receive the head of the wearer;

a pair of fastening devices disposed on the outer surface of the headwear; and a strap having two end portions and a length, at least a central portion of the length extending between the fastening devices, the strap having a first state in which the strap is secured by the fastening devices and the central portion of the strap is configured to extend from the headwear to engage with an upper portion of a seat to restrain the head to the seat, and the strap having a second state in which the end portions of the strap are configured to be substantially secured to the inner surface of the headwear, wherein the fastening devices comprise a first and a second slide, wherein when configured in the first state, the strap is moved along at least one of the first and second slides until the head of the wearer is substantially restrained against the seat, and in the second state, the strap is moved along at least one of the first and second slides until the length of the strap is substantially secured to the inner surface of the headwear, and further comprising:

a plurality of loops positioned about an interior region proximal to the opening for securing the length of the restraining device in place against the interior surface of the headwear.

2. The head apparel of claim 1, wherein the headwear is a baseball cap.

* * * * *